US009610473B2

(12) United States Patent
Chiang

(10) Patent No.: US 9,610,473 B2
(45) Date of Patent: Apr. 4, 2017

(54) EXERCISE DEVICE PROVIDING AUTOMATIC CALCULATION OF SEAT POSITION AND/OR CRANK LENGTH

(71) Applicant: Dyaco International Inc., Taipei (TW)

(72) Inventor: Hao Chiang, Taipei (TW)

(73) Assignee: DYACO INTERNATIONAL INC., Taipei (TW)

( * ) Notice: Subject to any disclaimer, the term of this patent is extended or adjusted under 35 U.S.C. 154(b) by 414 days.

(21) Appl. No.: 14/205,866

(22) Filed: Mar. 12, 2014

(65) Prior Publication Data

US 2015/0174446 A1 Jun. 25, 2015

(30) Foreign Application Priority Data

Dec. 20, 2013 (TW) ..... 102147429 A

(51) Int. Cl.

| | |
|---|---|
| ***A63B 22/06*** | (2006.01) |
| ***A63B 21/22*** | (2006.01) |
| ***A63B 71/06*** | (2006.01) |

(52) U.S. Cl.

CPC ..... *A63B 22/0605* (2013.01); *A63B 21/225* (2013.01); *A63B 21/227* (2013.01); *A63B 71/0619* (2013.01); *A63B 2022/0611* (2013.01); *A63B 2022/0623* (2013.01); *A63B 2071/065* (2013.01); *A63B 2225/093* (2013.01); *A63B 2225/096* (2013.01)

(58) Field of Classification Search

CPC ..... A63B 22/0605; A63B 21/227; A63B 71/0619; A63B 21/225; A63B 2071/065; A63B 2022/0623; A63B 2225/096; A63B 2022/0611

See application file for complete search history.

(56) References Cited

U.S. PATENT DOCUMENTS

| | | | | |
|---|---|---|---|---|
| 2008/0058170 A1* | 3/2008 | Giannascoli | ..... | A63B 69/16 482/57 |
| 2011/0077125 A1* | 3/2011 | Kenyon | ..... | A63B 22/0605 482/4 |
| 2011/0237397 A1* | 9/2011 | Mabey | ..... | A63B 22/0605 482/4 |

FOREIGN PATENT DOCUMENTS

| | | |
|---|---|---|
| CN | 201505399 U | 6/2010 |
| JP | 2007-089650 A | 4/2007 |

OTHER PUBLICATIONS

State Intellectual Property Office of the People's Republic of China , "Office Action", issued on Jul. 1, 2016.

* cited by examiner

*Primary Examiner* — Sundhara Ganesan
(74) *Attorney, Agent, or Firm* — WPAT, PC; Justin King

(57) ABSTRACT

An exercise device comprises a flywheel, a seat, a driving assembly, and a calculation module. The driving assembly drives the flywheel to rotate and comprises a driving wheel, a coupling member, and two cranks respectively connecting with a pedal. The coupling member connects the wheel and the flywheel. The user drives the wheel via the pedals. The calculation module performs a method to estimate a proper seat position and/or a crank length for the user.

6 Claims, 6 Drawing Sheets

| | Crank 1 | | Crank 2 | | Crank 3 | | Crank 4 | | Crank 5 | | Crank 6 | | Crank 7 | | Crank 8 | | Crank 9 | | Crank 10 | | Crank 11 | | Crank 12 | |
|---|---|---|---|---|---|---|---|---|---|---|---|---|---|---|---|---|---|---|---|---|---|---|---|---|
| Tube | Max | Min | Max | Min | Max | Min | Max | Min | Max | Min | Max | Min | Max | Min | Max | Min | Max | Min | Max | Min | Max | Min | Max | Min |
| 1 | 111 | 103 | 113 | 102 | 114 | 100 | 116 | 98 | 118 | 97 | 119 | 95 | 121 | 93 | 122 | 91 | 124 | 89 | 125 | 88 | 127 | 86 | 128 | 84 |
| 2 | 108 | 100 | 110 | 98 | 111 | 96 | 113 | 95 | 114 | 93 | 116 | 91 | 117 | 89 | 119 | 87 | 120 | 86 | 122 | 84 | 123 | 82 | 125 | 80 |
| 3 | 105 | 96 | 106 | 95 | 108 | 93 | 110 | 91 | 111 | 89 | 113 | 87 | 114 | 85 | 116 | 84 | 117 | 82 | 119 | 80 | 120 | 78 | 122 | 75 |
| 4 | 101 | 93 | 103 | 91 | 105 | 89 | 106 | 87 | 108 | 85 | 109 | 83 | 111 | 81 | 113 | 79 | 114 | 77 | 116 | 75 | 117 | 73 | 119 | 71 |
| 5 | 98 | 89 | 99 | 87 | 101 | 85 | 103 | 83 | 104 | 81 | 106 | 79 | 108 | 77 | 109 | 75 | 111 | 73 | 112 | 71 | 114 | 69 | 116 | 66 |
| 6 | 94 | 85 | 96 | 83 | 98 | 81 | 99 | 79 | 101 | 77 | 103 | 75 | 104 | 73 | 106 | 71 | 108 | 68 | 109 | 66 | 111 | 64 | 112 | 61 |
| 7 | 90 | 81 | 92 | 79 | 94 | 77 | 96 | 75 | 97 | 73 | 99 | 70 | 101 | 68 | 102 | 66 | 104 | 63 | 106 | 61 | 107 | 58 | 109 | 56 |
| 8 | 87 | 77 | 88 | 75 | 90 | 72 | 92 | 70 | 94 | 68 | 96 | 66 | 97 | 63 | 99 | 61 | 101 | 58 | 102 | 56 | 104 | 53 | 106 | 50 |
| 9 | 83 | 72 | 84 | 70 | 86 | 68 | 88 | 65 | 90 | 63 | 92 | 61 | 94 | 58 | 95 | 55 | 97 | 52 | 99 | 50 | 101 | 46 | 102 | 43 |
| 10 | 78 | 68 | 80 | 65 | 82 | 63 | 84 | 60 | 86 | 58 | 88 | 55 | 90 | 52 | 92 | 49 | 94 | 46 | 95 | 43 | 97 | 39 | 99 | 35 |
| 11 | 74 | 63 | 76 | 60 | 78 | 58 | 80 | 55 | 82 | 52 | 84 | 49 | 86 | 46 | 88 | 42 | 90 | 39 | 92 | 35 | 93 | 30 | 95 | 25 |
| 12 | 70 | 57 | 72 | 55 | 74 | 52 | 76 | 49 | 78 | 46 | 80 | 42 | 82 | 38 | 84 | 34 | 86 | 30 | 88 | 24 | 90 | 17 | 91 | 2 |

FIG.3

EXERCISE DEVICE PROVIDING AUTOMATIC CALCULATION OF SEAT POSITION AND/OR CRANK LENGTH

CROSS-REFERENCE TO RELATED APPLICATIONS

The entire contents of Taiwan Patent Application No. 102147429, filed on Dec. 20, 2013, from which this application claims priority, are incorporated herein by reference.

BACKGROUND OF THE INVENTION

1. Field of the Invention

The present invention relates to exercise devices, and more particularly relates to an exercise device providing symmetry index.

2. Description of Related Art

Flywheels typically constitute rotating devices useful for storing rotational energy. A flywheel is a spinning wheel rotor with a fixed axis whereby energy is stored in the rotor as rotational energy. Flywheels have a moment of inertia and thus resist changes in rotational speed. The rotational energy is proportional to the square of its rotational speed.

Upright bike and recumbent bike are exercise devices employing a flywheel generating a resistance, which can simulate biking and strengthen user's strength and cardiopulmonary function. For patients or people with unhealthy knees, however, the seat height and crank length of the bike probably are not fit, and they could feel pained and may injure during the adjustment procedure.

SUMMARY OF THE INVENTION

In one general aspect, the present invention relates to exercise devices, and more particularly relates to an exercise device providing automatic calculation of seat position and/or crank length.

In an embodiment of the present invention, an exercise device is provided with a flywheel, a seat, a driving assembly, and calculation module. A user sits on the seat. The driving assembly drives the flywheel to rotate and comprises a driving wheel, a coupling member, and two cranks respectively connecting with a pedal. The coupling member couples to the wheel and the flywheel, and the user drives the wheel via the pedals. The calculation module executes a steps of: obtaining a thigh length and a calf length according to the user's height; obtaining a data sheet according to the user's height; looking up the data sheet according to the user's limited knee flexion; and obtaining one or more "seat height" and/or "crank length" for the user.

In another embodiment of the present invention, a method is provided and applied to an exercise device comprising a driving wheel, two cranks, and a seat. the method calculates one or more seat height and/or crank length suitable for a user, comprising the steps of: obtaining a thigh length and a calf length according to the user's height; obtaining a data sheet according to the user's height; looking up the data sheet according to the user's limited knee flexion; and obtaining one or more "seat height" and/or "crank length" for the user.

BRIEF DESCRIPTION OF THE DRAWINGS

FIG. 3 illustrates a data sheet used in the method of FIG. 2 according to a preferred embodiment of the present invention.

DETAILED DESCRIPTION OF THE PREFERRED EMBODIMENT

Reference will now be made in detail to those specific embodiments of the invention. Examples of these embodiments are illustrated in accompanying drawings. While the invention will be described in conjunction with these specific embodiments, it will be understood that it is not intended to limit the invention to these embodiments. On the contrary, it is intended to cover alternatives, modifications, and equivalents as may be included within the spirit and scope of the invention as defined by the appended claims. In the following description, numerous specific details are set forth in order to provide a thorough understanding of the present invention. The present invention may be practiced without some or all of these specific details. In other instances, well-known process operations and components are not described in detail in order not to unnecessarily obscure the present invention. While drawings are illustrated in detail, it is appreciated that the quantity of the disclosed components may be greater or less than that disclosed, except where expressly restricting the amount of the components. Wherever possible, the same or similar reference numbers are used in drawings and the description to refer to the same or like parts.

Figure 1A:
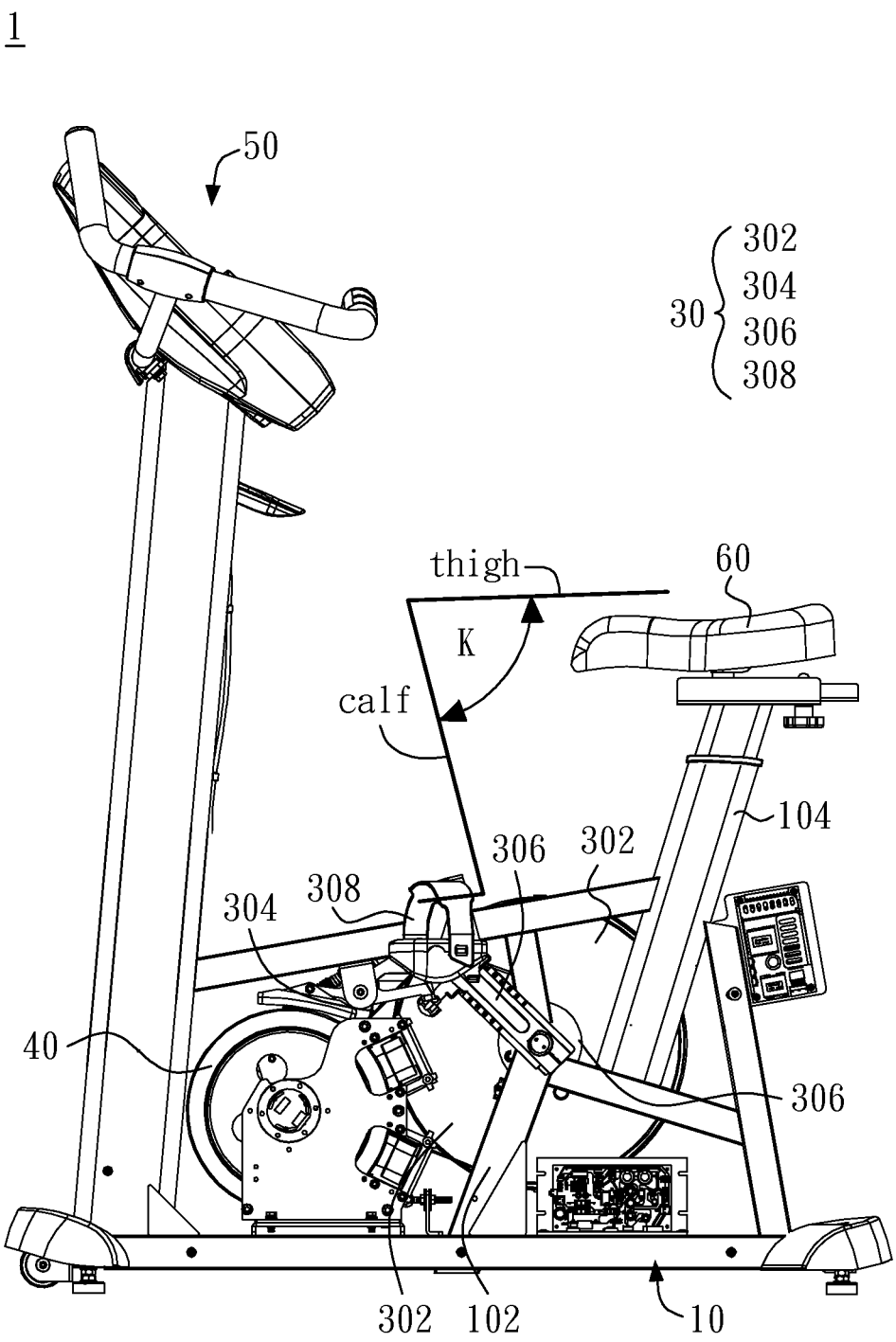
FIGS. 1A and 1B are side view and perspective view showing an exercise device according to a preferred embodiment of the present invention.
Figure 1B:
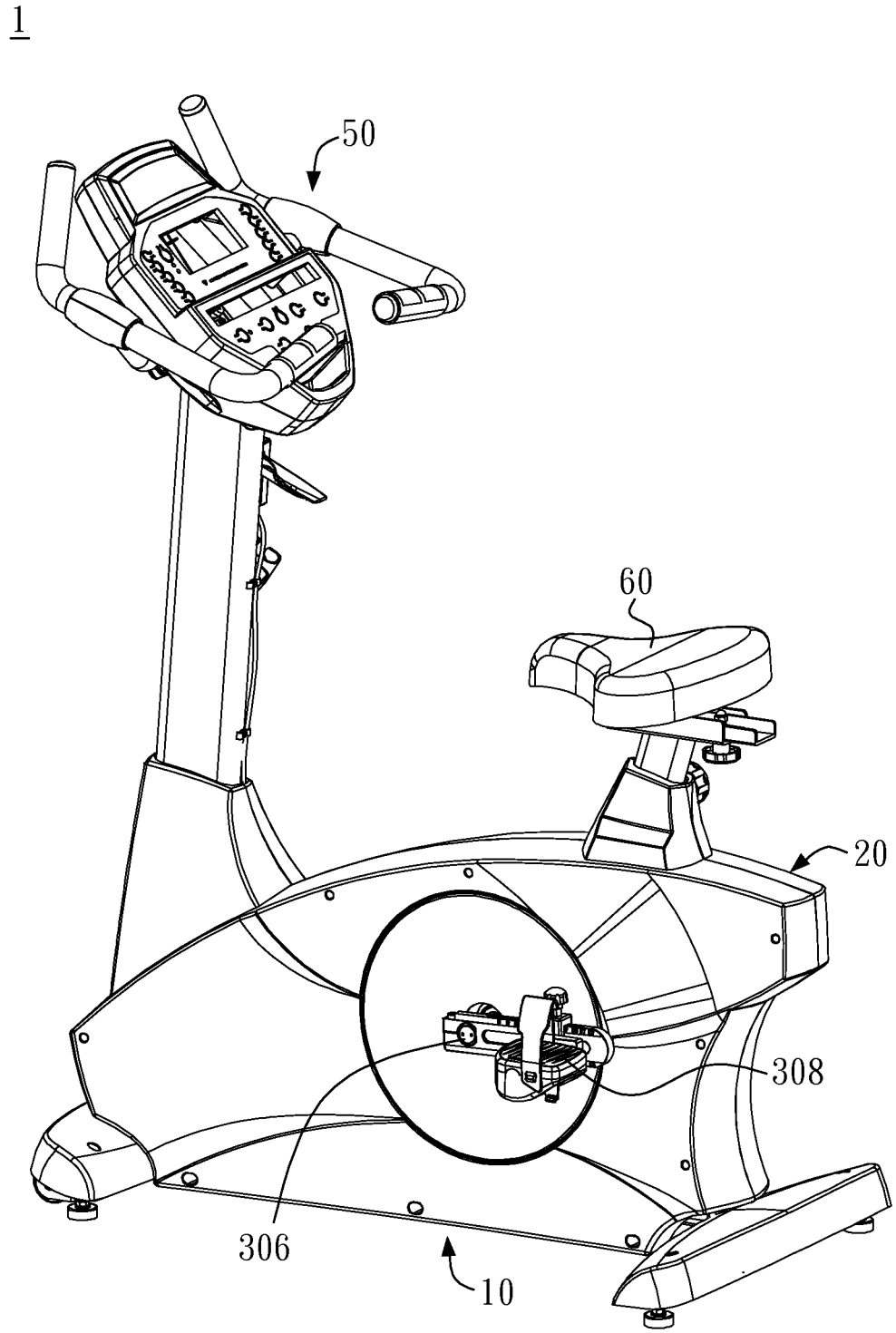

FIGS. 1A and 1B are side view and perspective view showing an exercise device according to a preferred embodiment of the present invention, in which a housing is omitted from FIG. 1B for clearly showing essential components of the exercise device.

As shown in FIGS. 1A and 1B, the exercise device 1 may comprise a frame 10, a housing 20, a driving assembly 30, a flywheel 40, a control panel 50, and a seat 60. A user sits on the seat 60 and drives the flywheel 40 to rotate via the driving assembly 30. A calculation module (not shown) is used to calculate a position of the seat 60 (a seat position) and a length of a crank 306 (a crank length) suitable for the user. The detail is described as follows.

In this preferred embodiment, the driving assembly 30 couples with the frame 10 and may comprise, but is not limited to, a driving wheel 302, a connecting member 304, two cranks 306, and two pedals 308. The frame 10 may comprise, but is not limited to, a bracket 102 and a supporting post 104. The driving wheel 302 may couple with the bracket 102, and the seat 60 may couple with the supporting post 104.

In addition, the driving wheel 302 indirectly connects to and drives the flywheel 40 via the connecting member 304. For instance, a small wheel (not shown) may couple to the flywheel 40 with a common axis, and the small wheel connects with the driving wheel 302 via the connecting member 304. The small wheel and the driving wheel 302 may be, but is not limited to, a pulley, a sprocket, a gear, or a timing pulley, gear, or wheel. The connecting member 304 may be, but is not limited to, a belt, a gear, or a timing gear or a timing belt corresponsive to the driving wheel 302. In this embodiment, the driving wheel 302 and the small wheel are pulley, and the connecting member 304 is a belt.

Further, each crank 306 has two ends, in which one end couples to an axle of the driving wheel 302 and the other couples to one of the two pedals 308. A user sits on the seat 60 with his or her feet respectively putting on the one of the two pedals 308. When the user simulates to ride a bicycle, the driving wheel 302 drives the flywheel 40 to rotate via the connecting member 304. In this embodiment, the flywheel 40 can rotate in two directions, namely, clockwise and counterclockwise directions.

Figure 2:
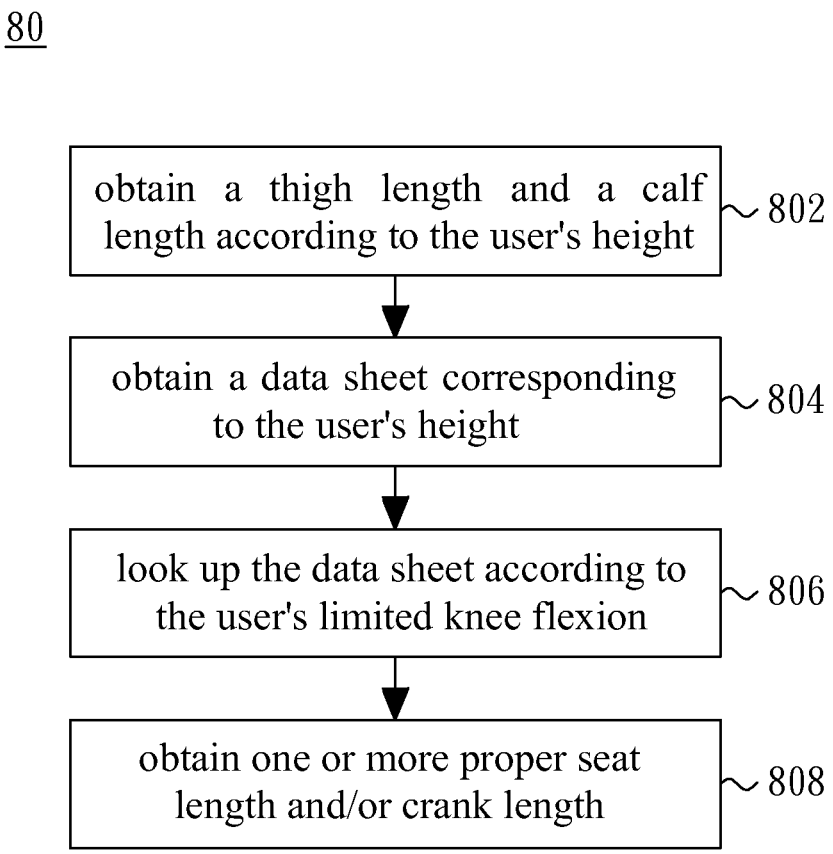
FIG. 2 shows a method for automatic calculating a seat position and a crank length of an exercise device according to a preferred embodiment of the present invention.

The calculation module executes a method 80 as shown in FIG. 2, so as to obtain a seat height and/or a crank length suitable for the user.

Step 802, according to the user's height, a thigh length and a calf length can be obtained. The user may input his or her height through the control panel 50.

A regression formula or a formula is used to obtain the thigh length and the calf length according to the user's height. The regression formula or the formula may be from a book, "The Measure of Man and Woman: Human Factors in Design," Alvin R. Tilley, Henry Dreyfuss Associates. Or, the regression formula or the formula may be from references or search reports regarding Body Segmental Parameters.

Step 804, a data sheet corresponding to the user's height is obtained. For example, if the user's height is 180 cm, then a data sheet corresponding to 180 cm is obtained. The data sheet can be applied and suited to at least the exercise device as shown in FIGS. 1A and 1B or other similar exercise devices. A specific height has a corresponding data sheet. In one embodiment, a height with range between 150 cm to 200 cm has a corresponding data sheet. These data sheets list a Max Knee Flexion (degree) and a Min Knee Flexion (degree) for each crank length (Crank 1, Crank 2, Crank 3 . . . ) and seat height (Tube 1, Tube 2, Tube 3 . . . ), which are suitable for the user with a specific height corresponding to this data sheet. FIG. 1A shows an angle K, the knee flexion equals to (180-K) degree.

Figure 5A:
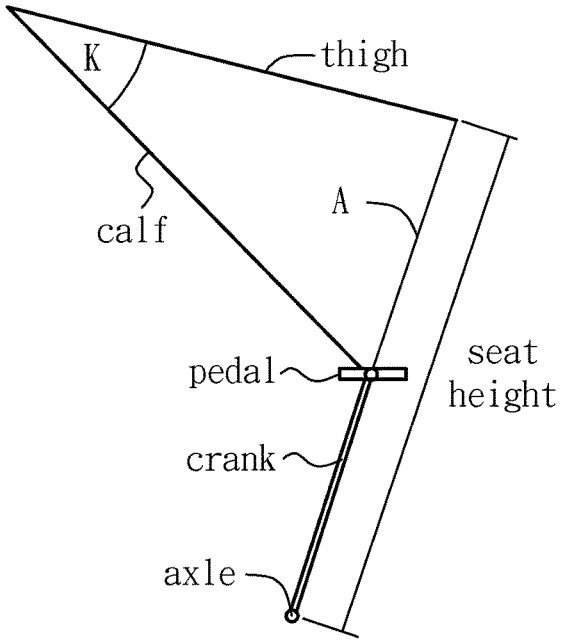
FIGS. 5A and 5B illustrate an operation principle for estimating data of FIG. 3.
Figure 5B:
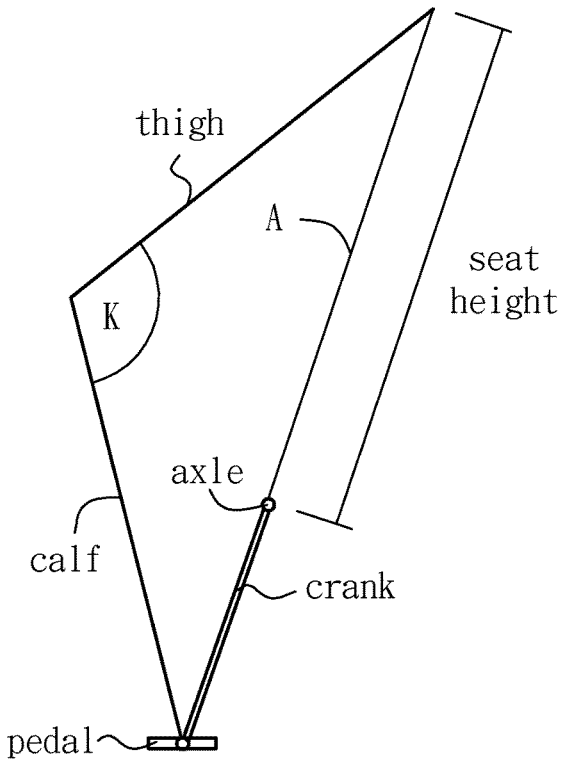

In one embodiment, all the data of FIG. 2 are calculated by method of FIGS. 5A and 5B. FIG. 5A shows that the knee flexion (180-K, degree) is max when the crank is rotated to this position, and FIG. 5B shows that the knee flexion (180-K, degree) is min when the crank is rotated to this position. In addition, giving a known crank length and a known seat height, the length of segment A can be calculated (A=seat length-crank length). Furthermore, with the known thigh length, calf length, and segment A length, the angle K can be obtained from trigonometric function, and the knee flexion equals to 180-K.

Step 806, according to the user's limited knee flexion, a proper seat length and/or a crank length are searched by looking up the data sheet of FIG. 2. The user can input his or her limited knee flexion by the control panel 50. For example, the user can input a limited knee flexion range, e.g., 30-50 degree, told by a doctor. And according to the user's limited knee flexion range, all seat length and/or a crank length of the data sheet are searched to find one or more proper seat length and/or crank length.

Step 808, one or more proper seat length and/or crank length are obtained by looking up the data sheet. The obtained one or more proper seat length and/or crank length may be displayed on the control panel 50. If the data is a plurality, the data with longest crank length has the priority to be display, and the data may be displayed in an order from the longest crank length to the shortest crank length.

According to another embodiment of the present invention, the Step 808 is different in which the data can be displayed by the user's request mode. For example, If the user request to display "seat height," then only the "seat height" data suitable for the user's height and limited knee flexion are displayed. And if the user request to display "crank length," then only the "crank length" data suitable for the user's height and limited knee flexion are displayed. In this preferred embodiment, if the user does not set the request, then both "seat height" and "crank length" will be displayed.

In another embodiment of the present invention, the Step 808 is different in which a most suitable "seat height" and/or "crank length" for the user are obtained and an adjustment module (not shown) adjust the seat 60 and the crank 306 to the obtained "seat height" and/or "crank length." In another embodiment of this invention, the control panel displays the obtained "seat height" and/or "crank length."

Except the bike shown in FIGS. 1A and 1B, the method of FIG. 2 can be executed in other exercise devices.

Figure 4:
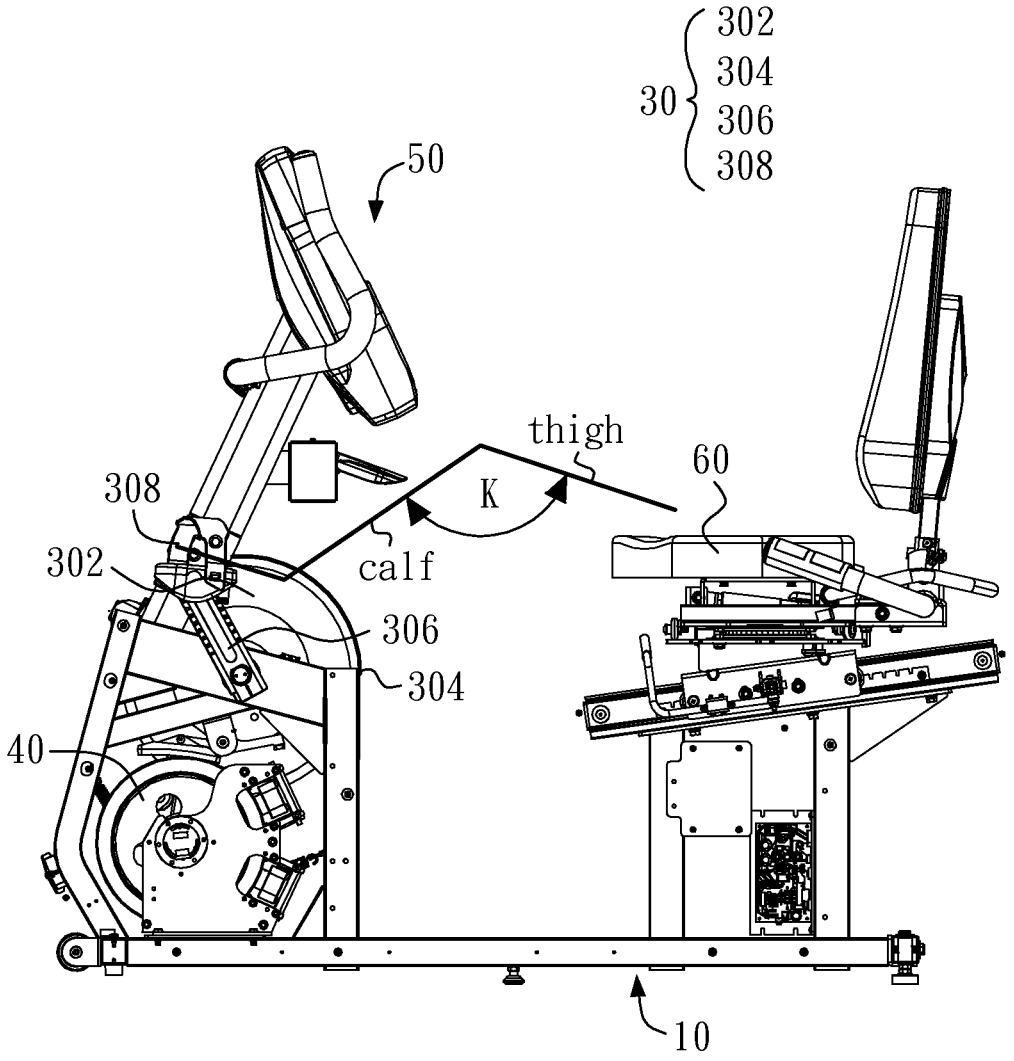
FIG. 4 is a side view showing an exercise device according to another preferred embodiment of the present invention.

FIG. 4 is a perspective view showing another exercise device according to another preferred embodiment of the present invention, in which a housing is omitted from FIG. 4 for clarity of essential components of the exercise device.

As shown in FIG. 4, the exercise device 2 may comprise a frame 10, a driving assembly 30, a flywheel 40, a control panel, and a seat 60. The function and the use of those components may be the same or similar to the foregoing embodiment and therefore are omitted.

For a person skilled in the art, alternatives, modifications, and equivalents may be made for the above-mentioned configuration, and those alternatives, modifications, and equivalents are within the scope of the present invention. For example, the driving wheel 302 and the flywheel 40 can be combined as a single wheel and the connecting member 304 can be omitted in another embodiment.

Accordingly, embodiments of this invention provide exercise devices and method proving suitable "seat height" and/or "crank length" for the user, so as to simply the adjustment procedure and protect the user from injuring during the adjustment procedure or use.

The intent accompanying this disclosure is to have each/all embodiments construed in conjunction with the knowledge of one skilled in the art to cover all modifications, variations, combinations, permutations, omissions, substitutions, alternatives, and equivalents of the embodiments, to the extent not mutually exclusive, as may fall within the spirit and scope of the invention. Corresponding or related structure and methods disclosed or referenced herein, and/or in any and all co-pending, abandoned or patented application(s) by any of the named inventor(s) or assignee(s) of this application and invention, are incorporated herein by reference in their entireties, wherein such incorporation includes corresponding or related structure (and modifications thereof) which may be, in whole or in part, (i) operable and/or constructed with, (ii) modified by one skilled in the art to be operable and/or constructed with, and/or (iii) implemented/made/used with or in combination with, any part(s) of the present invention according to this disclosure, that of the application and references cited therein, and the knowledge and judgment of one skilled in the art.

Conditional language, such as, among others, "can," "could," "might," or "may," unless specifically stated otherwise, or otherwise understood within the context as used, is generally intended to convey that embodiments include, and in other interpretations do not include, certain features, elements and/or steps. Thus, such conditional language is not generally intended to imply that features, elements and/or steps are in any way required for one or more embodiments, or interpretations thereof, or that one or more embodiments necessarily include logic for deciding, with or without user input or prompting, whether these features, elements and/or steps are included or are to be performed in any particular embodiment.

Although specific embodiments have been illustrated and described, it will be appreciated by those skilled in the art that various modifications may be made without departing from the scope of the present invention, which is intended to be limited solely by the appended claims.

What is claimed is:

1. An exercise device, comprising:

a flywheel;

a seat on which a user sit;

a control panel allowing the user to manipulate the exercise device;

a driving assembly driving the flywheel to rotate and comprising a driving wheel, a coupling member, and two cranks coupling to the driving wheel and respectively connecting with a pedal, the coupling member coupling to the driving wheel and the flywheel, the user driving the driving wheel via the pedals; and a calculation module executing a steps of:

receiving a height and a limited knee flexion range inputted through the control panel;

obtaining a thigh length and a calf length according to the height;

determining a Max Knee Flexion (degree) and a Min Knee Flexion (degree) by the thigh length and the calf length of the user for each of all possible combinations of seat heights of the seat and crank lengths of the two cranks;

obtaining one or more "seat height" and/or "crank length" from the calculated result having corresponded Max Knee Flexion (degree) and Min Knee Flexion (degree) suitable for the limited knee flexion range; and displaying the one or more "seat height" and/or "crank length" suitable for the limited knee flexion range on the control panel.

2. The exercise device as set forth in claim 1, wherein the thigh length and the calf length are obtained from a regression formula using the user's height.

3. The exercise device as set forth in claim 1, wherein the one or more "seat height" and/or "crank length" are obtained, and the obtained one or more "seat height" and/or "crank length" with the longest crank length is most suitable for the user.

4. A method used to an exercise device comprising a driving wheel, two cranks coupling to the driving wheel, a seat on which a user sit, and a control panel allowing the user to manipulate the exercise device, the method comprising the steps of:

inputting a height and a limited knee flexion range through the control panel by the user;

obtaining a thigh length and a calf length according to the user's height;

determining a Max Knee Flexion (degree) and a Min Knee Flexion (degree) by the thigh length and the calf length of the user for each of all possible combinations of seat heights of the seat and crank lengths of the two cranks; and obtaining one or more "seat height" and/or "crank length" from the calculated result having corresponded Max Knee Flexion (degree) and Min Knee Flexion (degree) suitable for the limited knee flexion range; and displaying the one or more "seat height" and/or "crank length" suitable for the limited knee flexion range on the control panel.

5. The method as set forth in claim 4, wherein the thigh length and the calf length are obtained from a regression formula using the user's height.

6. The method as set forth in claim 4, wherein the one or more "seat height" and/or "crank length" are obtained, and the obtained one or more "seat height" and/or "crank length" with the longest crank length is most suitable for the user.

* * * * *